United States Patent [19]

Matkan

[11] 4,398,497

[45] Aug. 16, 1983

[54] LIQUID ELECTROPHOTOGRAPHIC TONER APPLICATOR

[75] Inventor: Josef Matkan, Malvern, Australia

[73] Assignee: Coulter Systems Corporation, Bedford, Mass.

[21] Appl. No.: 275,868

[22] Filed: Jun. 22, 1981

[30] Foreign Application Priority Data

Jun. 25, 1980 [AU] Australia ..... PE4198

[51] Int. Cl.[3] ..... G03G 15/10

[52] U.S. Cl. ..... 118/661; 430/117; 430/118; 430/119; 118/662

[58] Field of Search ..... 430/117, 118, 119; 118/661

[56] References Cited

U.S. PATENT DOCUMENTS 3,367,791 2/1968 Lein ..... 430/119 X 3,672,326 6/1972 Schulze ..... 118/679

4,294,192 10/1981 Nakai et al. ..... 118/661 X

*Primary Examiner*—John D. Welsh

*Attorney, Agent, or Firm*—Silverman, Cass & Singer, Ltd.

[57] ABSTRACT

An applicator and method for applying liquid dispersed toner to the surface of an electrographic recording member, held on a platen which moves over a planar developing electrode, in which there is relative movement between the developing electrode and the recording member alternately in opposite direction, and in which there are at least two coplanar developing electrodes having toner fed therebetween, such as by a roller, and in which there are control means such as varying the direction of rotation of the roller to cause the developer to flow over either one or other of the developer electrodes according to the direction of relative movement of the platen.

15 Claims, 4 Drawing Figures

LIQUID ELECTROPHOTOGRAPHIC TONER APPLICATOR

BACKGROUND OF THE INVENTION

In the well known art of electrostatography a latent electrostatic image formed on the surface of a recording member is rendered visible or toned by application thereto of electroscopic marking particles which may be in the form of dry powder or in liquid dispersed form known as liquid toner. The recording member may comprise a photoconductive or dielectric printing element or an electrostatic master having insulative charge accepting and conductive non-chargeable areas and such like materials.

There are many prior art methods of applying liquid toner to such recording members. In one of such prior art methods it has been proposed to tone a recording member in the following manner. The recording member is held by suitable means against a flat platen, image bearing surface down. The platen is passed over a relatively short so-called developing electrode as is well known in the art and toning of the latent image on the recording member surface is effected over a narrow zone formed between such surface and the developing electrode where such zone is filled with liquid toner. As the platen with recording member traverses the electrode, the toning zone is constantly filled with fresh toner. This is attained by the following means. As the platen with the recording member commences traversing the electrode in the forward direction, it passes first over a supply roller which precedes the electrode and is partly immersed in toner contained within a reservoir located beneath said roller. The top of such supply roller is level with or is very slightly below the electrode surface. The edge of the electrode nearest the roller is in the shape of a knife-edge placed very close to the roller or nearly in contact or in virtual contact therewith. The supply roller rotates in the same direction as the platen traverses the electrode and the toner carried on the roller surface is removed therefrom by the electrode knife-edge and directed over the electrode surface, that is to say into the toning zone formed between said electrode surface and the traversing recording member surface. The speed of rotation of the supply roller is adjusted so that the volume of liquid carried by the roller to the electrode surface is sufficient to keep the toning zone full with fresh toner as the recording member traverses thereabove at some given speed.

It will be realised that this prior art toning mechanism is effective only when the platen is traversing the electrode in the forward direction because if its direction of traverse is reversed, the toning zone will not be filled with fresh toner as the direction in which the roller supplies toner to the electrode, that is the direction in which the toning zone is filled with toner will be opposite to the reverse movement of the platen. Thus it will be seen that there is need for a toning mechanism where the toning zone is constantly filled with fresh toner during the forward as well as the reverse traverse of the platen to obtain efficient toning in both directions.

OBJECT OF THE INVENTION

The object of this invention is to provide a method of and means for toning a recording member held against a flat platen where such platen traverses over developing electrodes spaced from said recording member surface over a narrow toning gap and where such toning gap is constantly filled with fresh toner supplied thereto by at least one supply roller and where such supply roller or rollers are adapted to change their direction of rotation and their proximity to the developing electrodes in accordance with the direction of traverse of the recording member thereabove.

THE INVENTION

The invention comprises a platen support member for an electrographic recording member and at least a pair of spaced-apart coplanar developing electrodes spaced from and generally parallel to the platen member to form between the platen member and the electrodes a toning gap, the platen member and electrodes being mounted to have relative reciprocating movement therebetween in the plane of the electrodes, and liquid toner supply means between the developing electrodes arranged to selectively flow toner outwards over one or other of the developing electrodes according to the direction of relative movement between the platen member and the electrodes.

The method consists in controlling the developer flow to be consistent with relative movement between the platen support member and the developing electrodes.

According to one form the method of applying liquid dispersed toner to the surface of an electrographic recording member comprises the steps of positioning an electrographic recording member on a flat palten support member arranged to traverse across two planar developing electrodes spaced apart below said flat platen, providing at least one supply roller in proximity to the planar developing electrodes, and mounted in adjustable relationship to the planar developing electodes, moving at least one supply roller into proximity with one planar developing electrode, rotating at least one supply roller to lift liquid dispersed toner to flow over the planar developing electrode, moving the platen in the same direction as the toner flow over the planar developing electrode to contact the toner incrementally with the electrographic recording member, traversing the platen across the planar developing electrodes, moving at least one supply roller into proximity with the other planar developing electrode, rotating at least one supply roller in the opposite direction to cause toner flow in the reverse direction across the planar developing electrode in proximity thereto, and moving the platen containing the electrographic recording member thereon across the planar developing electrodes in the opposite direction.

According to one form the means for the application of liquid dispersed toner to the surface of an electrographic recording member consist essentially of a flat platen support member for the electrographic recording member and two planar developing electrodes spaced from and below the flat platen support member to form a toning gap, characterised by the toning gap being constantly filled with fresh toner supplied thereto by at least one supply roller in proximity to the developing electrodes, the supply roller or rollers being adapted to change direction of rotation and proximity to the developing electrodes in accordance with the direction of traverse of the flat platen support member carrying the electrographic recording member thereabove.

BRIEF DESCRIPTION OF THE DRAWINGS

The invention will now be described in more detail with reference to the accompanying drawings, where.

PREFERRED EMBODIMENTS

Figure 1:
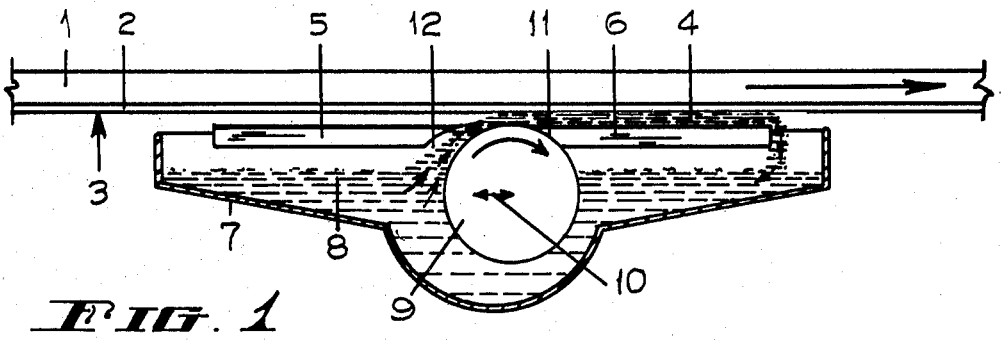
FIGS. 1 and 2 illustrate a single supply roller configuration providing efficient toning in the forward and reverse direction of traverse of a recording member, respectively.

Referring now to FIG. 1 in detail, platen 1 has attached thereto, by means not shown, the recording member 2 having a surface 3 to be toned. Toning is effected in a narrow zone 4 formed between the recording member surface 3 and the toning electrodes 5 and 6. The platen 1 traverses both electrodes 5 and 6 in the forward direction as shown and the length of such traversing path is selected to be sufficient to tone the surface 3 along the full length of the recording member 2. Beneath electrodes 5 and 6 a tank 7 is provided containing liquid toner 8 therein. A supply roller 9, mounted in sliding or movable bearings, (not shown) is adapted to be moved in the direction shown by the arrow 10 which is parallel to the direction of traverse of the platen 1. Supply roller 9 is moved towards electrode 6 to a position where a very narrow gap 11 is formed between its surface and the knife-edge shaped end of the electrode 6 or where its surface contacts or virtually contacts the knife-edge end of the electrode 6 and consequently where a wide gap 12 is formed between its surface and the knife-edge end of electrode 5. The top of the supply roller 9 is level with or just slightly below the upper surface of the electrodes 5 and 6. Supply roller 9 rotates in the direction shown, which is the same as the forward direction of the platen 1. Rotating supply roller 9 is partly immersed in toner 8 and carries, in upward direction through the wide gap 12, toner on its surface. The toner carried up by the supply roller 9 is removed or substantialy removed from its surface at the very narrow gap 11 by the knife-edge end of electrode 6 or by contact or virtual contact therewith and such toner is directed into the toning zone 4 formed between recording member surface 3 and electrode 6. As the platen 1 traverses in forward direction as shown, toning zone 4 is constantly filled with fresh toner fed thereto by the supply roller 9 over the knife-edge end of the electrode 6 where the recording member surface 3 enters the toning zone 4 and such toner is discharged at the other end of the electrode 6, that is at the point where the recording member surface 3 exits from toning zone 4.

It should be noted that the prior art toning mechanism referred to earlier consists of one supply roller and one only electrode operating as described in the foregoing in relation to the forward direction of traverse of platen 1 as shown in FIG. 1. It will be realized that if in FIG. 1 the direction of traverse of platen 1 is reversed while the position and direction of rotation of supply roller 9 remain the same as shown, as is the case in the prior art toning mechanism having only one electrode equivalent to electrode 6 of FIG. 1, toning zone 4 will not be filled with toner or it will be filled only in part with toner near the knife-edge end of the electrode 6 because the flow of the toner carried by the supply roller 9 into the toning zone 4 will be blocked or limited at the knife-edge end of the electrode 6 by the platen 1 traversing in a direction opposite to the direction of such toner flow, hence toning in the virtually empty or only partly filled toning zone will be very inefficient.

Figure 2:
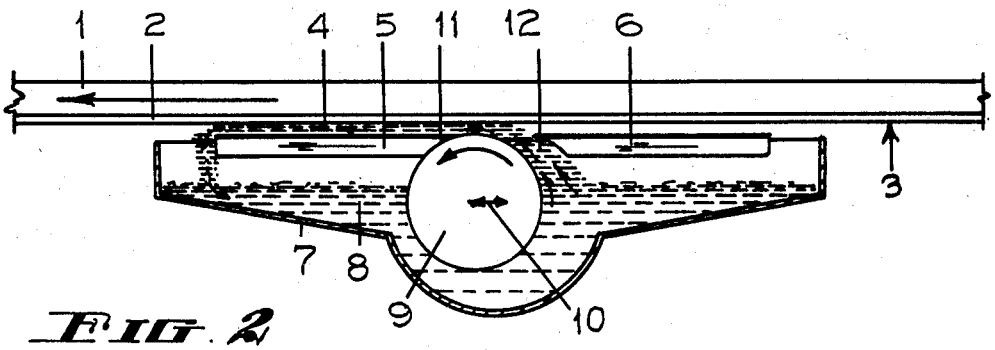

In FIG. 2 is shown the arrangement whereby in accordance with this invention efficient toning can be attained during the traverse of the platen 1 in the reverse direction. Upon completion of toning in the forward direction as shown in FIG. 1, that is after the rear end of platen 1 has traversed past the electrode 6, the platen 1 is stopped, the rotation of the supply roller 9 is stopped, and the supply roller 9 is moved, by means not shown, to the position shown in FIG. 2, that is towards electrode 5 to form a very narrow gap 11 between its surface and the knife-edge end thereof and to form a wide gap 12 between its surface and the knife-edge end of the electrode 6, supply roller 9 is caused to rotate in the direction shown whereby toner is now carried over the electrode 5 and the platen 1 is caused to traverse in the reverse direction as shown over the toning zone 4 which is constantly filled with fresh toner.

Figure 3:
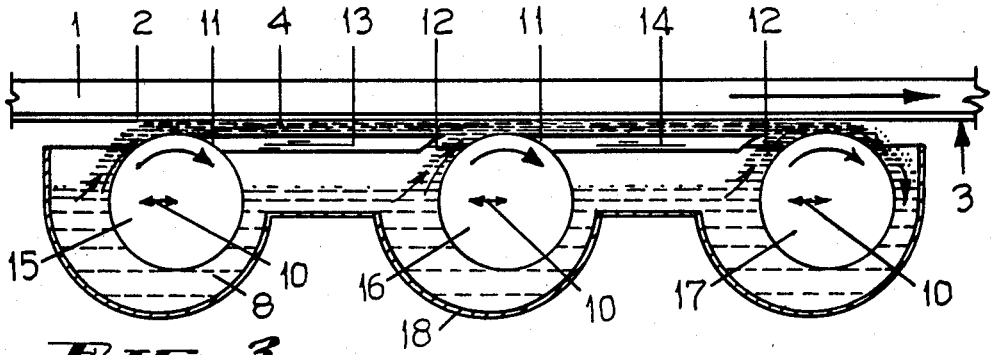
FIGS. 3 and 4 illustrate a triple supply roller configuration providing efficient toning in the forward and reverse direction of traverse of a recording member, respectively.
Figure 4:
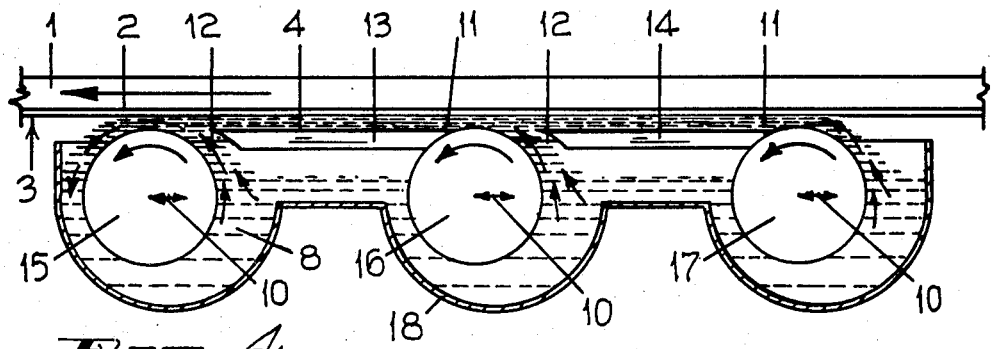

FIGS. 3 and 4 illustrate another embodiment of this invention wherein toning efficiency is further improved during both the forward and reverse traverse of the platen.

In FIG. 3 the platen 1, having attached thereto the recording member 2 with surface 3 to be toned, traverses in the forward direction as shown, and toning is effected in toning zone 4 formed between the recording member surface 3 and the electrodes 13 and 14 which are knife-edge shaped at both ends. Three supply rollers 15, 16 and 17 are partly immersed in toner 8 contained in the tank 18 and are mounted in slidable or movable bearings adapted to be moved in the direction of the arrow 10. The rollers are moved to the position shown and are rotating in the direction shown whereby very narrow gaps 11 are formed between the surface of the roller 15 and the rear knife-edge end of electrode 13 as well as between the surface of the roller 16 and the rear knife-edge end of the electrode 14. Roller 15 fills the toning zone 4 above the electrode 13 and the toner is returned to the tank 18 through the wide gap 12 formed between the front knife-edge end of the electrode 13 and the surface of the roller 16, whereas the roller 16 fills the toning zone 4 above the electrode 14 and the toner from this zone is returned to the tank 18 through the wide gap 12 formed between the front knife-edge of electrode 14 and the surface of the roller 17. When the platen 1 traverses in the forward direction, the roller 17 can be stationary, if so desired. It will be realized that in this configuration the gaps 12 have to be wide enough to allow for toner return from toning zone 4 above one electrode and simultaneously to allow for toner to be carried on the supply roller for feeding the toning zone 4 above the other electrode.

In FIG. 4 is shown the operation of the supply rollers during the reverse direction of traverse of the platen 1. In this case the supply roller 17 has been moved towards the electode 14 to feed the toning zone 4 thereabove, whereas the supply roller 16 has been moved towards the electrode 13 to feed the toning zone 4 thereabove. During traverse in reverse direction of platen 1 supply roller 15 can be stationary, if so desired.

The configuration shown in FIGS. 3 and 4 can be modified to operate with one electrode and two supply rollers only, such as for instance electrode 13 with supply rollers 15 and 16 or electrode 14 with supply rollers 16 and 17.

Whilst in general the dimensions of electrodes and supply rollers, speeds of platen traverse and of supply roller rotation will depend from case to case on equipment and process parameters, typical dimensions and speeds can be given as follows. Electrode length from knife-edge end to straight end or from knife-edge end to knife-edge end 3 to 6 inches, toning zone that is distance between electrode and recording member surface 0.005 to 0.030 inch, typically 0.020 inch, supply roller diameter about 2.75 inch with top of roller nearly level or slightly below the electrode surface where the large gap formed between the supply roller surface and the knife-edge end of the electrode is about 0.020 to 0.030 inch whereas the narrow gap formed therebetween is about 0.033 to 0.004 inch and where the speed of rotation of the supply roller is in the range 100 to 150 RPM at the platen traversing speed of about 0.75 to 2 inches per second. It will be realized that for a given traversing speed of the platen the speed of rotation of the supply roller and the gap sizes have to be adjusted to obtain good toner flow for feeding the toning zone with fresh toner and keeping it constantly filled therewith.

The recording member can be held to the platen by vacuum or other means, such as for instance by magnetic means in case the base of the recording member is magnetically attractable.

The supply rollers can be mounted in slidable or movable bearings or the bearings of the supply rollers can be contained in a pivotally mounted swinging arm and such and similar supports for the supply rollers can be adapted to be moved from the position for forward platen traverse operation to reverse traverse operation and vice versa by solenoid plungers or hydraulic rams or the like means which can be activated in accordance with a suitable event timing and sequencing program for a particular equipment and process.

It will be realized that electrical biasing as is well known in the art can be applied between the electrodes of the above described embodiments and a conductive backing of the recording member. For instance the conductive backing of the recording member or the platen itself may be held at ground potential whilst a biasing voltage is applied to the electrodes, or the electrodes themselves can be also at ground potential for so-called virtual biasing or the electrodes can be electrically fully isolated for so-called floating bias. Thus in most instances it will be found advantageous to mount the electrodes as well as the supply rollers if found necessary in such manner that they are electrically isolated from the surrounding parts of the equipment.

There has been described a method of toning the surface of a recording member, over a toning zone and methods of and means for maintaining supply of fresh toner in such toning zone have been disclosed. The dimensions of various parts and distances as well as operational speeds disclosed in the foregoing are intended to be taken in illustrative rather than in a restrictive sense.

The arrows depicted in the developer liquid show the direction of flow.

I claim:

1. The method for the application of liquid dispersed toner to the surface of an electrographic recording member consisting in the steps of (a) positioning said electrographic recording member on a flat platen support member arranged for relative movement over at least a pair of spaced-apart coplanar developing electrodes which form with the said platen member a developer gap (b) providing a flow of liquid dispersed toner to the space between the two said spaced-apart developing electrodes and directing the flow of the said toner outwards over either the one or the other said developing electrodes to flow through the said developer gap and (c) alternately changing the direction of flow of the said toner in the said developer gap while changing the relative direction of movement of the said platen member in relation to the said developer electrodes.

2. The method of claim 1 using an array of spaced-apart developing electrodes in co-planar assembly and causing the said toner to flow though each space between the developer electrodes in a selected uniform direction into the said toning gap, and alternately changing the direction of developer flow over the said developer electrodes.

3. The method of claim 1 or 2 using roller means having the axis parallel to the plane of the said developing electrodes to supply liquid dispersed toner on to the said coplanar developing electrodes comprising causing the lower part of the said roller means to dip into a body of the liquid dispersed toner, rotating the said roller means in one direction, guiding the said liquid toner from an upper part of the said roller means on to a said developing electrode on a first side of the said roller means, reversing the direction of rotation of the said roller means, and guiding the said liquid toner from the upper part of the said roller means on to a developing electrode on a second side of the said roller.

4. The method of claim 3 using a gap between the said coplanar developing electrodes of a dimension wider than the upper part of the said roller disposed between the said electrodes, and causing relative movement between the rotational axis of the said roller means and the said developer electrodes whereby to cause a gap between the said roller means and the said electrode on a first side thereof and to cause the electrode on the other side of the said roller means to be in close proximity to the said roller means on a second side thereof to cause developer liquid carried by the said roller to flow over the said developing electrode on the said second side and maintaining the rotation of the said roller means to cause a first rising side of the said roller means to carry the said developer liquid through the said gap on to the said developing electrode on the said second side of the said roller.

5. The method for the application of liquid dispersed toner to the surface of an electrographic recording member as defined in claim 1 consisting of the steps of positioning said electrographic recording member on a flat platen support member arranged to traverse across two planar developing electrodes spaced apart from and below said flat platen, providing at least one supply roller in proximity to said planar developing electrodes, said at least one supply roller being mounted in adjustable relationship to said planar developing electrodes, moving said at least one supply roller into proximity with one planar developing electrode, rotating said at least one supply roller to lift liquid dispersed toner to flow over said planar developing electrode, moving said platen in the same direction as said toner flow over said planar developing electrode to contact said toner incrementally with said electrographic recording member, traversing said platen in said direction across said planar developing electrodes, moving said at least one supply roller into proximity with the other planar developing electrode, rotating said at least one supply roller in the opposite direction to cause toner flow in the reverse direction across said planar developing electrode in proximity thereto, and moving said platen containing said electrographic recording member thereon across said planar developing electrodes in said opposite direction.

6. The method of toning a recording member having a recording surface carrying an electrostatic latent charge image and comprising the steps of holding the recording member on a flat platen with the recording surface facing outward, providing at least a pair of laterally spaced coplanar developing electrodes having coplanar surfaces spaced parallel to the recording surface defining a toning gap between said recording surface and the said electrodes, effecting relative parallel movement of one of said platen and said electrodes selectively in opposite directions, feeding toner to at least one of said coplanar surfaces during said relative movement, positioning toner feed roller means communicating to a toner container with a portion of the circumferential surface thereof between said spaced planar surfaces with the top portion of said feed roller means proximate the level of said coplanar surfaces, slidably moving said toner feed roller means in the same direction of travel as the movable one of said platen and electrodes, establishing a predetermined minimal spacing between said roller means and said movable one so that toner is fed to the planar surface which is positioned leading in the direction of movement taken by the movable one during movement and to the other one of said coplanar surfaces during reverse movement and reversing the direction of rotation of the toner feed roller with change in the relative direction of said movement.

7. The method as claimed in claim 6 and the step of providing a longitudinal knife-edge along the opposite sides of the electrodes.

8. The method as claimed in claim 6 and reversing the direction of rotation of the toner feed roller means simultaneous with the reversal of the direction of said relative movement and said slidable movement.

9. The method as claimed in claim 6 wherein the direction traversed by the recording member is the same as the direction of rotation of the toner feed roller.

10. Means for the application of liquid dispersed toner to the surface of an electrographic recording member comprising a platen support member for an electrographic recording member and developing electrode means spaced form the said platen member to form a toning gap, characterised in that at least a pair of spaced-apart coplanar developing electrodes are used spaced from and generally parallel to the platen member to form between the platen member and the electrodes the said toning gap, the platen member and electrodes being mounted to have relative movement therebetween in the plane of the said developing electrodes, further characterised by liquid toner supply means between the developing electrodes arranged to selectively flow toner outwards over the one or the other of the developing electrodes according to the direction of relative movement between the said platen member and the said electrode.

11. Means for the application of liquid dispersed toner to the surface of an electrographic recording member according to claim 10 consisting essentially of a flat platen support member for said electrographic recording member and two planar developing electrodes spaced from and below said flat platen support member to form a toning gap, characterized by said toning gap being constantly filled with fresh toner supplied thereto by at least one supply roller in proximity to said developing electrodes, said supply roller or rollers being adapted to change direction of rotation and proximity to said developing electrodes in accordance with the direction of traverse of said flat platen support member carrying said electrographic recording member thereabove.

12. Means for the application of liquid dispersed toner to the surface of an electrographic recording member as disclosed in claim 11, further characterised by said at least one supply roller comprising one roller mounted between said planar developing electrodes with its axis parallel to said planar developing electrodes, the uppermost portion of said supply roller being at or near the same horizontal level as the upper surfaces of said developing electrodes, and said developing electrodes being knife-edged along the edge adjacent to said supply roller, said supply roller being mounted to move towards each of said developing electrodes sequentially and simultaneously being caused to rotate in the direction adapted to carry toner towards that developing electrode in close proximity to said supply roller.

13. Means for the application of liquid dispersed toner to the surface of an electrographic recording member as disclosed in claim 12, further characterised by said at least one supply roller comprising one roller mounted between said planar developing electrodes and a further two supply rollers mounted adjacent to the opposite edges of each of said planar developing electrodes, said supply rollers being mounted with their axes parallel to said planar developing electrodes and their uppermost portions at or near the same horizontal level as the upper surfaces of said developing electrodes, said developing electrodes being knife-edged along each edge adjacent to a supply roller, said supply rollers being mounted to move towards each adjacent developing electrode sequentially and simultaneously being caused to rotate in the direction adapted to carry toner towards the developing electrode in close proximity to said supply rollers.

14. Means for the application of liquid dispersed toner to the surface of an electrographic recording member as disclosed in claim 12, further characterised by said at least one supply roller being mounted above a toner tank of a shape adapted to cause at least portion of said at least one supply roller to be immersed in liquid dispersed toner contained in said toner tank.

15. A toning device for an electrostatic latent image carried by a recording member surface, comprising a liquid toner container opening to the recording surface, at least a pair of laterally spaced coplanar development electrodes proximate the opening of said container facing the recording surface and spaced therefrom to define a toning gap therebetween, liquid toner feed rollers means disposed between said electrodes and in communication with the toner in said container, means mounting said toner feed roller means for rotation within said container, means for moving one of the recording surface and electrode pair horizontally relative the other in a first direction with the toner feed roller being rotatable in said first direction and reversing the direction of movement from the first direction to a second direction, means mounting said toner feed roller means for limited horizontal slidable movement from a first position closely proximate one electrode during said movement in said first direction and a second position closely proximate the other electrode during said reverse movement, and the direction of rotation of the toner feed roller means being the same as the direction of horizontal movement of the movable one of said recording member and electrodes.

* * * * *